US012077267B2

(12) United States Patent
Davison

(10) Patent No.: US 12,077,267 B2
(45) Date of Patent: Sep. 3, 2024

(54) ELEMENT FOR A FLOATING DOCK AND A FLOATING DOCK

(71) Applicant: Marine IP Limited, Lymington (GB)

(72) Inventor: Christopher Davison, Lymington (GB)

(73) Assignee: Marine IP Limited, Lymington (GB)

( * ) Notice: Subject to any disclaimer, the term of this patent is extended or adjusted under 35 U.S.C. 154(b) by 753 days.

(21) Appl. No.: 17/242,558

(22) Filed: Apr. 28, 2021

(65) Prior Publication Data

US 2021/0347452 A1 Nov. 11, 2021

(30) Foreign Application Priority Data

May 1, 2020 (GB) ..... 2006446

(51) Int. Cl.
*B63C 1/02* (2006.01)

(52) U.S. Cl.
CPC ..... *B63C 1/02* (2013.01)

(58) Field of Classification Search
CPC ..... B63C 1/02
See application file for complete search history.

(56) References Cited

U.S. PATENT DOCUMENTS 4,714,375 A * 12/1987 Stevenson ..... B63C 1/12 405/1
10,315,738 B2 * 6/2019 Imel ..... B63C 1/02
2005/0172876 A1 * 8/2005 Ostreng ..... B63C 1/02 114/45
2006/0042533 A1 * 3/2006 Munro ..... B63B 21/00 114/230.15
2016/0145822 A1 * 5/2016 Gerst ..... B63C 1/02 114/220
2018/0257749 A1 * 9/2018 Arnold ..... B63C 1/02

FOREIGN PATENT DOCUMENTS

AU 2007227334 A1 * 10/2008 ..... B63C 3/06
EP 3904197 A1 * 11/2021 ..... B63B 3/02
GB 2509502 A 9/2014
GB 2594513 A * 11/2021 ..... B63B 3/02
GB 2610418 A * 3/2023 ..... B63B 1/06
JP 2007526850 A * 9/2007 ..... B63C 1/06
JP 2020019440 A 6/2020
WO WO-2019101590 A1 * 5/2019 ..... B63B 27/36

OTHER PUBLICATIONS

"GB Search Report from Application GB2006446.5", Sep. 29, 2020.

* cited by examiner

*Primary Examiner* — S. Joseph Morano
*Assistant Examiner* — Jovon E Hayes
(74) *Attorney, Agent, or Firm* — Blanchard Horton PLLC

(57) ABSTRACT

An element for use in a watercraft is provided comprising a first rotatable support member mounted on the element such that the position of the first rotatable support member relative to the element can be varied by a user. A floating dock comprising at least one element is also provided.

21 Claims, 5 Drawing Sheets

ELEMENT FOR A FLOATING DOCK AND A FLOATING DOCK

CROSS-REFERENCE TO RELATED APPLICATIONS

This application claims priority under the Paris Convention to Great Britain Application Number GB2006446.5, filed on May 1, 2020, the entire content of which is incorporated herein by reference.

FIELD OF INVENTION

The present invention relates to an element for a floating dock and a floating dock comprising the element.

BACKGROUND

Modular floating docks are well known in the art and are frequently created via the assembly of a number of floating subunits. These subunits or elements include various geometric shapes connected together to provide a floating dock with the shape, size and support capabilities desired. Such modular floating docks are popular, as they provide a convenient way to construct a dock or other floating platform of any shape and size based on a consumer's needs.

It is also known to use such modular systems to construct floating docks that can be driven on to by a watercraft under its own power. Here, the individual subunits or elements that form the floating dock or platform are selected to provide a pathway up which the watercraft can be driven. These subunits may also be shaped to hold the watercraft in place on the dock or platform once the watercraft has ceased movement. It is further known that a watercraft may be manually moved onto the dock or platform, for example by winching, towing, pushing or pulling the watercraft.

However, the present solutions for the provision of such floating docks and or platforms are not without their problems. To support a watercraft out of the water, the individual modular subunits or elements that hold the watercraft in place must be carefully shaped to provide the required support without inhibiting the watercraft's initial passage from the water. As such, at present, specific designs and configurations are required for each different size and type of watercraft.

The highly specialized nature of such docks and platforms can be undesirable, as it reduces the versatility of the floating dock or platform. This may be problematic in situations where a large number of different types of vessels need to be docked at a single location. Additionally, the need for such variation increases manufacturing costs as it is necessary to develop and manufacture a wide range of products to accommodate all users.

It is also notable that the present solutions can be problematic where a watercraft has a keel. Where a boat has a large keel, or indeed any keel, the keel structure can prevent the use of a modular floating dock as it cannot be accommodated within the modular floating docks or platforms presently available.

Embodiments and aspects of the present invention seek to address at least the above problems of the prior art.

BRIEF SUMMARY OF THE INVENTION

According to a first aspect of the present invention there is provided an element for use in a floating dock, the element comprising a first rotatable support member; wherein the first rotatable support member is mounted on the element such that the position of the first rotatable support member relative to the element can be varied by a user.

In this way there is advantageously provided an element for use in a floating dock that can be adjusted to accommodate a variety of differently shaped and sized watercraft. The adjustability of the rotatable support member means that the location of the rotatable support member can be changed to accommodate different sized craft, either before installation of the floating dock, or during use where a floating dock is used by multiple different kinds of watercraft. Such a system may also be advantageous as it may hold a watercraft securely in position. This is in contrast to many existing systems, where a watercraft may rock or otherwise move position on the floating dock, creating the potential for crush injuries. As such, the present invention may provide a safer dock.

Preferably, the height of the first rotatable support member relative to the element can be varied by a user. Preferably the angle between the first rotatable support member and the element can be varied by a user. Most preferably, both the height and angle of the first rotatable support member can be varied relative to the element by a user.

Preferably, the height of the first rotatable support member relative to the element can be varied between a plurality of predetermined positions. Alternatively, the height of the first rotatable support member relative to the element can be varied continuously between a predetermined upper position and a predetermined lower position.

Preferably, the angle between the first rotatable support member and the element can be varied between a plurality of predetermined positions. Alternatively, the angle between the first rotatable support and the element can be varied continuously between a predetermined maximum angle and a predetermined minimum angle.

Preferably, the element comprises a second rotatable support member. More preferably, the second rotatable support member is spaced from the first rotatable support member. More preferably, the first rotatable support member and the second rotatable support member are located on opposite sides and/or at opposing ends of the element.

Preferably, the second rotatable support member is mounted on the element such that the position of the second rotatable support member relative to the element can be varied by a user. Preferably, the height of the second rotatable support member relative to the element can be varied by a user. Preferably the angle between the second rotatable support member and the element can be varied by a user. Most preferably, both the height and angle of the second rotatable support member can be varied relative to the element by a user.

Preferably, the height of the second rotatable support member relative to the element can be varied between a plurality of predetermined positions. Alternatively, the height of the second rotatable support member relative to the element can be varied continuously between a predetermined upper position and a predetermined lower position.

Preferably, the angle between the second rotatable support member and the element can be varied between a plurality of predetermined positions. Alternatively, the angle between the second rotatable support and the element can be varied continuously between a predetermined maximum angle and a predetermined minimum angle.

More preferably, the position of both the first and second support members can be varied as hereinbefore described.

Preferably, the element comprises a first end portion. More preferably, the first rotatable support member is mounted on the first end portion. Preferably, the element comprises a second end portion. More preferably, the second rotatable support member is mounted on the second end portion. Preferably, the element comprises an intermediate portion extending between the first end portion and the second end portion.

Preferably, the first end portion, the second end portion and the intermediate portion are all distinct units or components. Alternatively, the first end portion, the second end portion and the intermediate portion are integrally formed. Preferably, the first end portion, second end portion and the intermediate portion are formed substantially of plastic.

Preferably, the intermediate portion comprises an intermediate rotatable support member. More preferably, the rotatable support member comprises a roller. Alternatively, the intermediate support member comprises a wheel. Preferably, the intermediate portion comprises a plurality of intermediate rotatable support members.

Preferably, the intermediate rotatable support member is mounted on the element such that the position of the intermediate rotatable support member relative to the element can be varied by a user. Preferably, the height of the intermediate rotatable support member relative to the element can be varied by a user. Preferably the angle between the intermediate rotatable support member and the element can be varied by a user. Most preferably, both the height and angle of the intermediate rotatable support member can be varied relative to the element by a user.

Preferably, the height of the intermediate rotatable support member relative to the element can be varied between a plurality of predetermined positions. Alternatively, the height of the intermediate rotatable support member relative to the element can be varied continuously between a predetermined upper position and a predetermined lower position.

Preferably, the angle between the intermediate rotatable support member and the element can be varied between a plurality of predetermined positions. Alternatively, the angle between the intermediate rotatable support and the element can be varied continuously between a predetermined maximum angle and a predetermined minimum angle.

More preferably, the position of the first, second and intermediate support members can all be varied as hereinbefore described.

Preferably, the intermediate portion is connected to the first end portion and the second end portion such that, in use, when a load is placed on the element the connections between the end portions and the intermediate element become more secure. Such a feature is advantageous as it ensures the structure of the dock or platform remains complete even under heavy loads. Such a feature may be provided by choosing an appropriately shaped connection structures between the end portions and the intermediate portion.

Preferably, the intermediate portion is connected to the first end portion by a first engagement formation. More preferably, the intermediate portion is connected to the first end portion by a plurality of first engagement formations.

Preferably, the first engagement formation comprises a first protrusion extending from the first end portion into a first recess in the intermediate portion, where the first recess is sized to fit the first protrusion. Preferably, the first end portion and the intermediate portion are held together by an interference fit. Preferably, the first end portion and the intermediate portion are held together by a friction fit.

Preferably, the first engagement formation comprises a primary tapered portion and a secondary nodule. Preferably, the secondary nodule is located closer to a center line of the element than the primary tapered portion. Preferably, the secondary nodule is located on the intermediate portion. Preferably, the primary tapered portion is continuous along the length of the element. Preferably, the secondary nodule is discontinuous along the length of the element.

Preferably, the first engagement formation comprises at least one line of symmetry. More preferably, the first engagement formation comprises at least two lines of symmetry.

Preferably, the intermediate portion is connected to the second end portion by a second engagement formation. More preferably, the intermediate portion is connected to the second end portion by a plurality of second engagement formations.

Preferably, the second engagement formation comprises a second protrusion extending from the second end portion into a second recess in the intermediate portion, where the second recess is sized to fit the second protrusion. Preferably, the second end portion and the intermediate portion are held together by an interference fit. Preferably, the second end portion and the intermediate portion are held together by a friction fit.

Preferably, the second protrusion comprises a primary tapered portion and a secondary nodule. Preferably, the wherein the secondary nodule is located closer to a center line of the element than the primary tapered portion. Preferably, the secondary nodule is located on the intermediate portion. Preferably, the primary tapered portion is continuous along the length of the element. Preferably, the secondary nodule is discontinuous along the length of the element.

Preferably, the second engagement formation comprises at least one line of symmetry. More preferably, the second engagement formation comprises at least two lines of symmetry.

Preferably, the first engagement formation comprises a protrusion and a recess. Preferably, the second engagement formation comprises a protrusion and a recess. Preferably the first engagement formation and the second engagement formation are substantially identical. Preferably, the first engagement formation and the second engagement formation are substantially mirror images of one another.

Preferably, the intermediate portion is reversibly connected to the first end portion. Preferably, the intermediate portion is reversibly connected to the second end portion. More preferably, the intermediate portion is reversibly connected to both the first end portion and the second end portion.

Preferably, the first rotatable support member comprises a wheel. More preferably, the first rotatable support member comprises a plurality of wheels. More preferably, at least one wheel comprises a pneumatic tire, preferably with tread. Preferably, the wheel is mounted on an axle. Preferably the axle is held in position via a locking pin. Preferably, the first rotatable support member comprises a roller. Preferably, the wheel may be a solid wheel, more preferably a polymeric solid wheel. A solid wheel may be preferable as it cannot be punctured in use.

Preferably, the second rotatable support member comprises a wheel. More preferably, the second rotatable support member comprises a plurality of wheels. More preferably, at least one wheel comprises a pneumatic tire, preferably with tread. Preferably, the wheel is mounted on an axle. Preferably, the axle is held in position via a locking pin. Preferably, the second rotatable support member comprises a roller. Preferably, the wheel may be a solid wheel, more preferably a polymeric solid wheel. A solid wheel may be preferable as it cannot be punctured in use.

Preferably, the element is buoyant in fresh water at a temperature of 20° C. Preferably, the first end portion is buoyant in fresh water at a temperature of 20° C. Preferably, the second end portion is buoyant in fresh water at a temperature of 20° C. Preferably, the intermediate portion is buoyant in fresh water at a temperature of 20° C. More preferably, the first end portion, second end portion and intermediate portion are all buoyant in fresh water at a temperature of 20° C.

Preferably, the element is buoyant in salt water with a salinity of 35 parts per thousand at a temperature of 20° C. Preferably, the first end portion is buoyant in salt water with a salinity of 35 parts per thousand at a temperature of 20° C. Preferably, the second end portion is buoyant in salt water with a salinity of 35 parts per thousand at a temperature of 20° C. Preferably, the intermediate portion is buoyant in salt water with a salinity of 35 parts per thousand at a temperature of 20° C. More preferably, the first end portion, second end portion and intermediate portion are all buoyant in salt water with a salinity of 35 parts per thousand at a temperature of 20° C.

Preferably, the intermediate portion is a different color to the first end portion and the second end portion. More preferably, the intermediate portion is red, yellow white or orange and the first end portion and the second end portion are black, grey or blue.

Preferably, the first end portion, second end portion and intermediate portion are connected to one another via an adhesive or glue. Preferably the first end portion, second end portion and intermediate portion are held together via a bar. More preferably, the bar is a resilient bar. Preferably the first end portion, second end portion and intermediate portion are held together via a tether. Preferably, the tether is flexible. Preferably the first end portion, second end portion and intermediate portion are held together via one or more screws and or bolts.

Preferably, the element has a maximum dimension of around 1 meter. Preferably, the element is substantially cuboidal.

According to a second aspect of the present invention, there is provided a floating dock comprising at least one element as hereinbefore described.

In this way, a floating dock is provided that may advantageously accommodate a variety of types of watercraft.

Preferably, the floating dock comprises a plurality of the elements hereinbefore described mounted adjacent one another. More preferably, the elements abut one another.

BRIEF DESCRIPTION OF THE FIGURES

Embodiments of the present invention will now be described by way of example and with reference to the accompanying drawings, in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Figure 1:
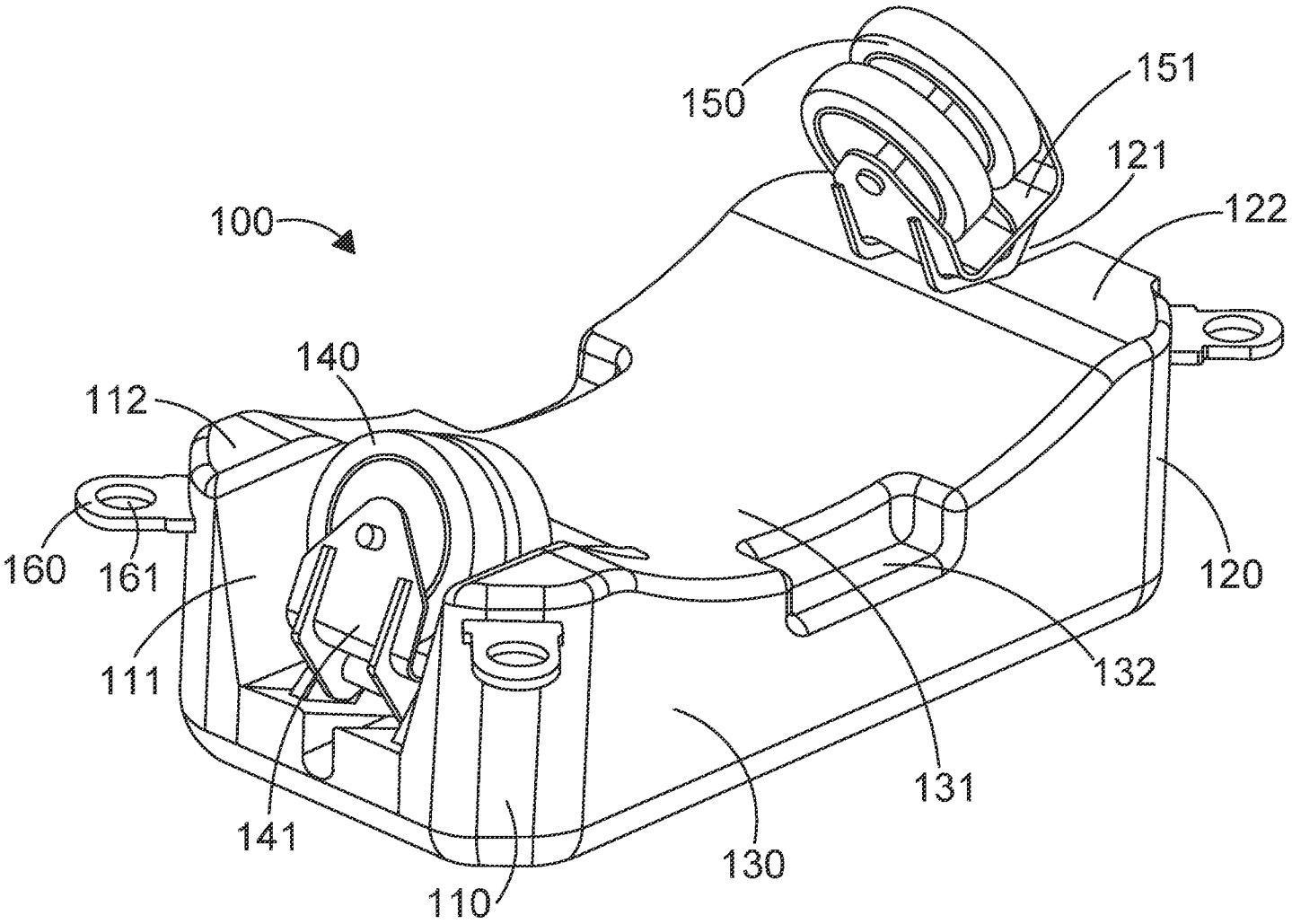
FIG. 1 is a schematic view of an element according to a first embodiment of the present invention.

Referring firstly to FIG. 1, there is depicted an element 100 for use in a floating dock or platform comprising a first end portion 110, a second end portion 120 and an intermediate portion 130. The first end portion 110, second end portion 120 and intermediate portion 130 are all integrally formed, with the intermediate portion 130 lying between the end portions 110, 120. Therefore, the main body of the element 100 is a single, continuous structure. The total width of the element 100 is in the order of 1 m, though other sizes are envisaged.

The first end portion 110 comprises a first rotatable support member 140. In this embodiment of the invention, the first rotatable support member 140 is a pair of coaxial wheels. The first rotatable support member 140 is connected to the first end portion 110 by a first mounting arm 141. The first mounting arm 141 is connected to the first end portion 110 such that the position of the pair of wheels can be adjusted or changed relative to the first end portion 110. The first mounting arm 141 can be extended to adjust the amount the pair of wheels protrudes above the surface of the first end portion 110. Additionally, the first mounting arm 141 is connected to the first end portion 110 such that the angle of the wheels with respect to the first end portion 110 can be adjusted as required. The wheels are connected to the first end portion by the first mounting arm 141 such that the wheels may be continually adjusted between a position where they are fully recessed within an indentation or void 111 in the first end portion 110 and a position where the wheels lie completely above a top surface 112 of the first end portion 110. The first mounting arm 141 is connected to the first end portion 110 such that the user can lock it in position.

The intermediate portion 130 extends from the first end portion 110, connecting it to the second end portion 120. The intermediate portion 130 is substantially cuboid in shape, but has a curved top surface 131. The top surface 131 curves downwardly from where it connects to the first end portion 110 to a low point in at the center of the intermediate portion. From that point, the top surface 131 curves back upwards to where it meets the second end portion 120. As such, the top surface 131 of the intermediate portion is substantially C shaped. The intermediate portion 130 further comprises two intermediate indentations or voids 132, these intermediate indentations located on opposite sides of the top surface 131 at the lowest point of the curve.

The second end portion 120 comprises a second rotatable support member 150. In this embodiment of the invention, the second rotatable support member 150 is a pair of coaxial wheels. The second rotatable support member 150 is substantially identical to the first rotatable support member 140.

The second rotatable support member 150 is connected to the second end portion 120 by a second mounting arm 151. The second mounting arm 151 comprises each and every feature of the first mounting arm 141. As such, each of the capabilities and functions previously described in relation to the first mounting arm 141 is also applicable to the second mounting arm 151, with the exception that any changes made in the angle and/or position of the second rotatable support members 150 by the second mounting arm 151 are in relation to the second end portion 120, not the first end portion 110. The second end portion 120 further includes an indentation 121 and top surface 122 equivalent to those described in relation to the first end portion 110. As such, the element 100 has two perpendicular planes of symmetry.

The first end portion 110 and the second end portion 120 both comprise connection tabs 160 at each of their upper external corners such that the element 100 can be connected to adjacent elements in a modular dock or platform structure. Each of these connection tabs 160 comprises a connection aperture 161 though which a connecting member (not shown) may be inserted to connect adjacent elements together.

In use the first 141 and second 151 mounting arms can be adjusted to independently control the position of the first rotatable support member 140 and the second rotatable support member 150 respectively to enable the element 100 to be used to support a wide range of different shaped and sized watercraft on a floating dock or platform.

Figure 2:
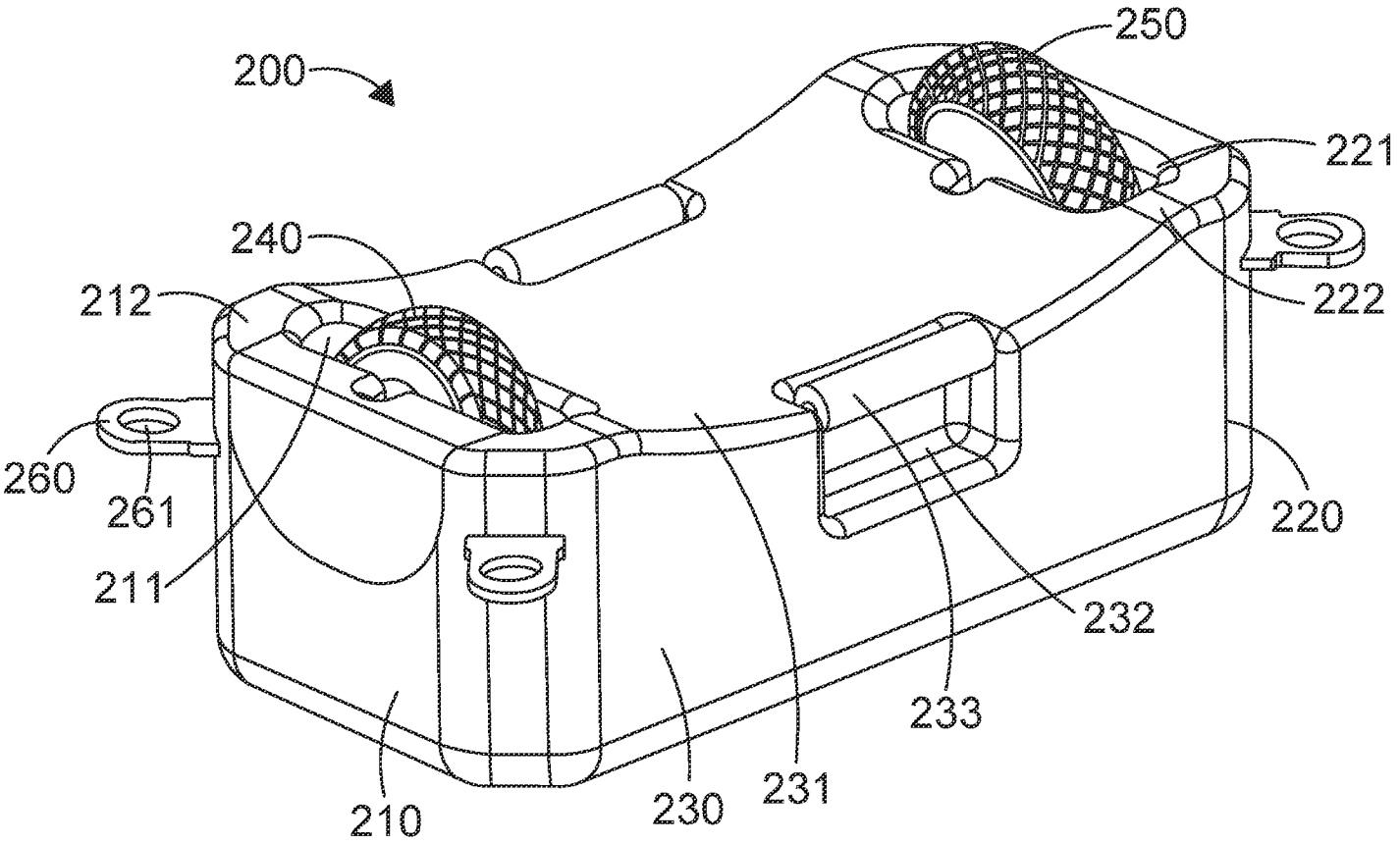
FIG. 2 is a schematic view of an element according to a second embodiment of the present invention.

Referring now to FIG. 2, there is depicted an element 200 according to a second embodiment of the present invention.

Element 200 again comprises a first end portion 210, a second end portion 220 and an intermediate portion 230. As previously described in relation to FIG. 1, the first end portion 210, second end portion 220 and intermediate portion 230 are integrally formed such that the element 200 is a single, continuous structure. Again, the total width of the element 200 depicted in FIG. 2 is around 1 m, although other sizes are envisaged.

The first end portion 210 comprises a first rotatable support member 240 in the form of a single wheel mounted on an axle (not shown) within the first end portion 210. The single wheel comprises a pneumatic tire with tread. The wheel lies substantially within an indentation 211 located in the first end portion 210, with some of the wheel protruding above a top surface 212 of the first end portion.

The axle is located within a slot within the indentation 211. The position of the axle within this slot can be adjusted by the user as required, with this change in position of the axle having a concomitant effect of the position of the wheel. As such, movement of the axle can be used to adjust the angle between the wheel and the first end portion 210 and the position of the wheel relative to the first end portion 210. The axle can be locked into position within the slot to ensure it does not move during use.

The intermediate portion 230 extends from the first end portion 210 in the same fashion as described in relation to FIG. 1. In addition, the intermediate portion comprises all the features of the intermediate portion 130 described in FIG. 1, including two intermediate indentations 232. In the present embodiment, each of these intermediate indentations 232 contains an intermediate support member 233 in the form of a roller. Each roller has a longitudinal axis that lies substantially parallel with the longitudinal axis of the element 200. Additionally, each roller lies across the center of the intermediate portion 230. Each roller protrudes above the top surface 232 of the intermediate portion 230 and is free to rotate.

The second end portion 220 comprises a second rotatable support member 250. The second rotatable support member 250 is substantially identical to the first rotatable support member 240 in that it is a pneumatic wheel with a treaded tire.

The second rotatable support member 250 is connected to the second end portion 220 by a further axle. This further axle is functionally identical to the axle supporting the first rotatable support member 240. As such, this further axle allows the second rotatable support structure 250 to move in relation to the second end portion 220 exactly as the first axle allows the first rotatable support structure 240 to move in relation to the first end portion 210. As shown, the wheel lies substantially within an indentation 221 located in the first end portion 220, with some of the wheel protruding above a top surface 222 of the first end portion.

The element 200 illustrated in FIG. 2 comprises connection tabs 260 with connection apertures 261 identical to those disclosed in relation to FIG. 1. Again, the element 200 has two perpendicular planes of symmetry.

Once more, in use, the axles can be adjusted to independently control the position of the first rotatable support member 240 and the second rotatable support member 250 respectively to enable the element 200 to be used to support a wide range of different shaped and sized watercraft on a floating dock or platform.

Figure 3:
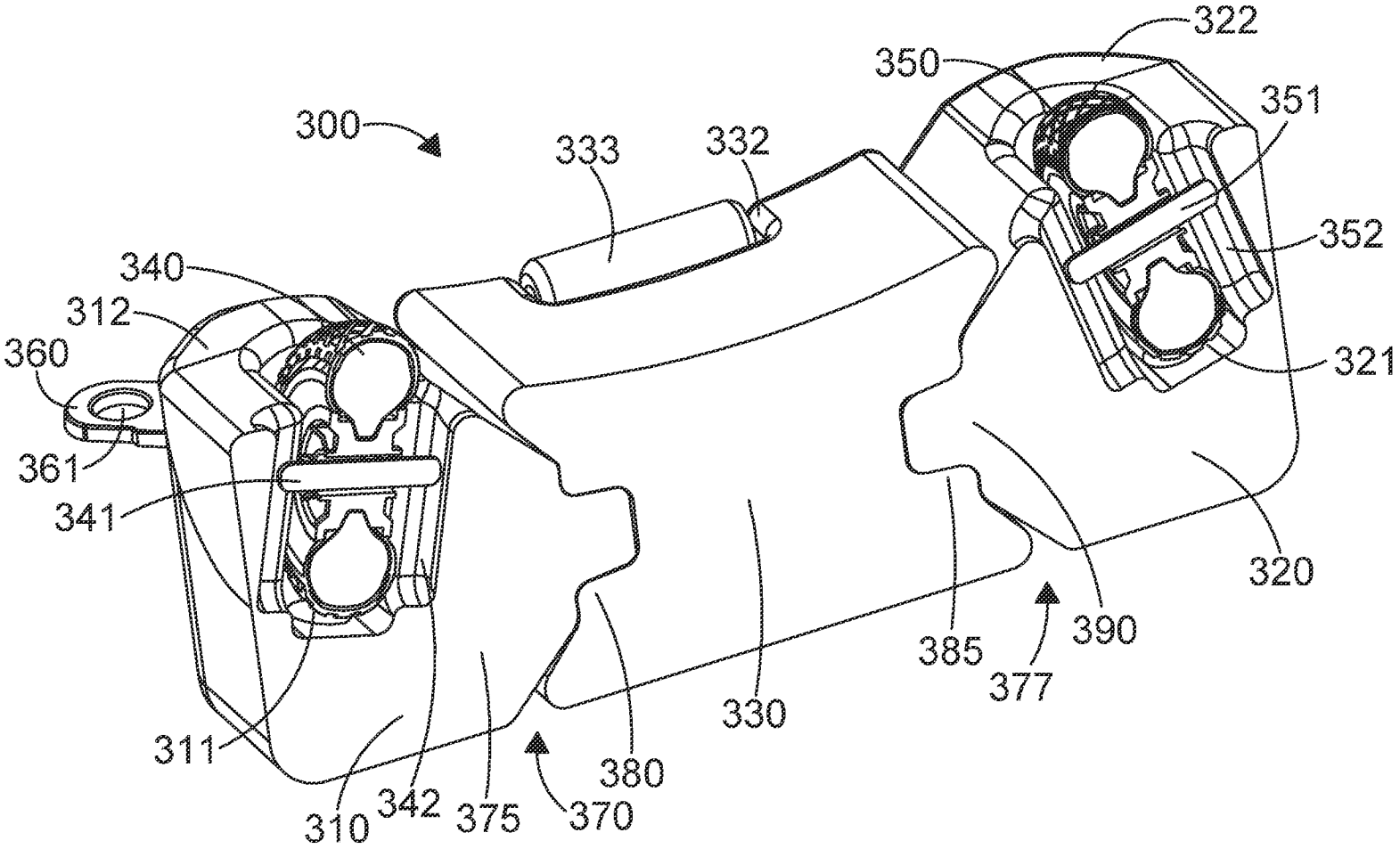
FIG. 3 is a schematic cross-sectional view of an element according to a third embodiment of the present invention.

Referring now to FIG. 3, there is illustrated a cross section of an element 300 including a first end portion 310, a second end portion 320 and an intermediate portion 300. As can be seen in FIG. 3, the first end portion 310, second end portion 320 and intermediate portion 330 are all discrete units formed individually and separately from one another.

To form the complete element 300, the first end portion 310 is reversibly connected to the intermediate portion 330, and the second end portion 320 is reversibly connected to the intermediate portion 300. As such, the intermediate portion 330 lies between the first end portion 310 and the second end portion 320. Similarly as described in relation to FIG. 2, this third embodiment of the invention comprises a first rotatable support member 340 in the form of a single wheel mounted on an axle 341 within the first end portion 310. Again, the single wheel comprises a pneumatic tire with tread. The wheel lies substantially within an indentation 311 located in the first end portion 310, with some of the wheel protruding above a top surface 312 of the first end portion.

The axle 341 is located within a slot 342 within the indentation 311. As can be seen in FIG. 3, the slot 342 extends substantially the entire height of the indentation 311 and is found in two opposing walls of the indentation 311. As such, the slot 342 is elongate and forms a channel within which the axle 341 can move relative to the element 300 to position the first rotatable support member 340 relative to the element 300. The slot 342 is dimensioned such that the axle 342 fits within, with the length of the axle 341 being substantially equal to the width of the slot 342. The axle 341 can move vertically within the slot 342 until fixed in position by a user, such that the protrusion of the first rotatable support member 340 above the first end portion 310, and the angle of the first rotatable support member 340 relative to the element 300, can be adjusted as required by the user. The first rotatable support member 340 is free to rotate around the axle 341 without contacting the inner surfaces of the indentation 311.

FIG. 3 further depicts an intermediate indentation in the intermediate portion 332, the intermediate indentation 332 containing an intermediate support member 333 in the form of a roller as outlined in relation to FIG. 2. The second end portion 320 comprises a second rotatable support member 350. The second rotatable support member 350 is substantially identical to the first rotatable support member 340 in that it is a pneumatic wheel with a treaded tire.

The second rotatable support member 350 is connected to the second end portion 320 by a further axle 351. This further axle is functionally identical to the axle 341 supporting the first rotatable support member 340. As such, this further axle 351 lies within a slot 352 and allows the second rotatable support structure 350 to move in position and angle relative to the second end portion 320 exactly as the first axle 341 allows the first rotatable support structure 340 to move in relation to the first end portion 310.

The element 300 illustrated in FIG. 3 again comprises connection tabs 360 with connection apertures 361 identical to those disclosed in relation to FIG. 1 and FIG. 2. Again, the element 300 has two perpendicular planes of symmetry.

Returning to the connection between the first end portion 310 and the intermediate portion 330, the two are connected by an engagement formation 370. Here, the engagement formation comprises a first protrusion 375 extending from the first end portion 310 and a first recess 380 located within the intermediate portion 330. The first protrusion 375 is sized such that it fits within the first recess 380, and the first end portion 310 and the intermediate portion 330 are held together by a friction fit.

The first protrusion 375 generally tapers down as it extends away from the first end portion 310. As such, the cross sectional area of the first protrusion 375 reduces as the distance away from the first rotatable support member 340 increases and the first protrusion 375 approaches the center of the element 300.

The first protrusion 375 comprises a first section that tapers substantially continuously and smoothly, and a second portion defined by a sudden decrease in the cross sectional area of the first protrusion. The second portion as illustrated in FIG. 3 is in the form of a nodule or knob. Whilst the first portion extends continuously along the length of the first end portion 310, the second portion is discontinuous. The second portion may be held more tightly by friction fit within the first recess 380 than the first portion 375.

The connection between the second end portion 320 and the intermediate portion 330 is a mirror image of the connection between the first end portion 310 and the intermediate portion 330 with a second engagement formation 377 comprising a second recess 385 and a second protrusion 390 comprising first and second portions. Due to the shape of the first 375 and second 390 protrusions and the first 380 and second 385 recesses, the portions 310, 320, 300 of the element 300 become more securely held together as the weight placed on the element 300 increases. In other words, the protrusions 375, 390 act as keystones.

Figure 4:
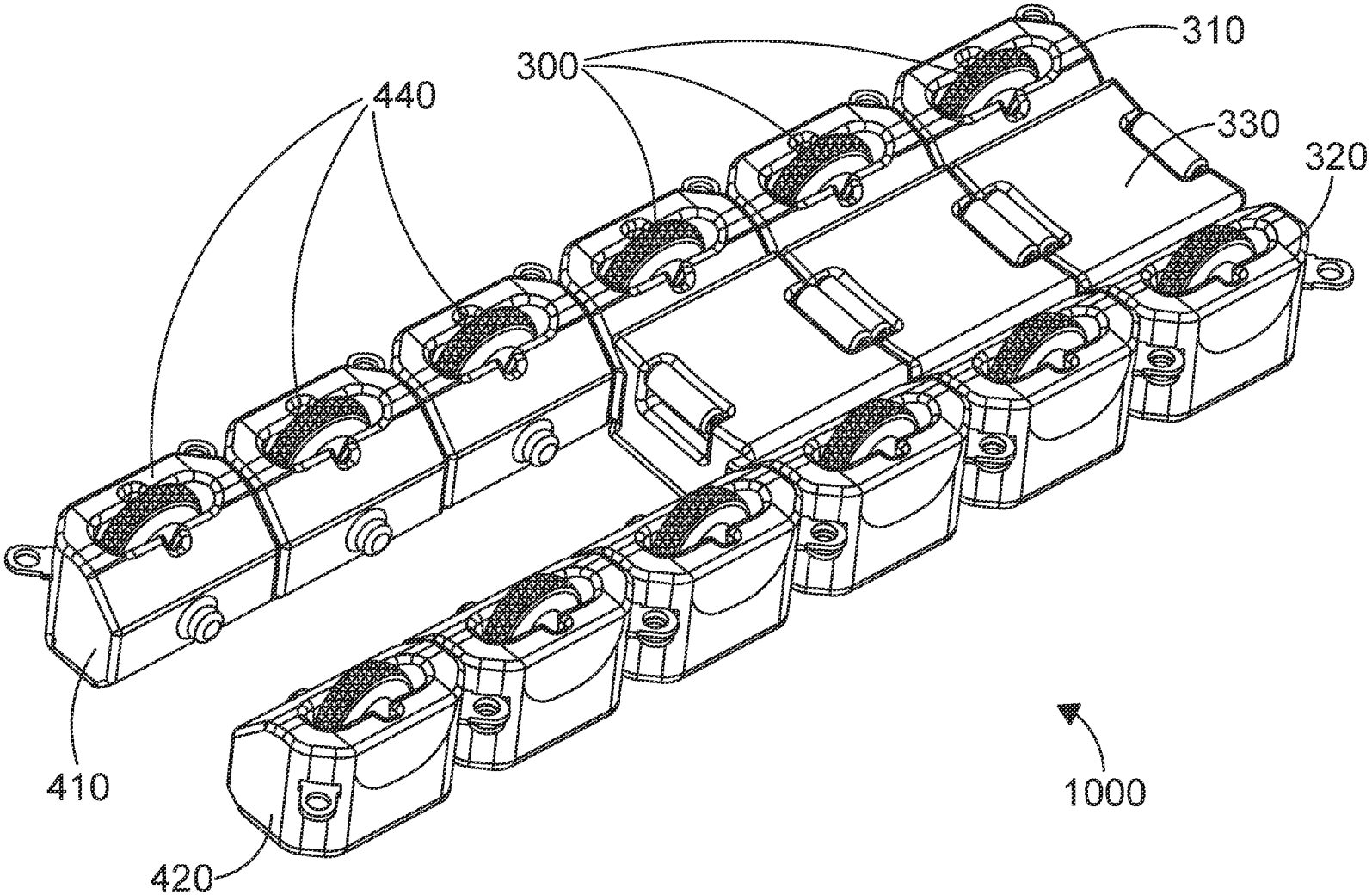
FIG. 4 is a schematic view of a dock comparing a plurality of the elements depicted in FIG. 3.

FIG. 4 depicts a floating dock 1000 or platform including a plurality of the elements 300 of FIG. 3. Three of the elements 300 are connected together in series such that the rotatable members located on each portion are aligned with one another. In this configuration, the elements 300 form a channel up which a watercraft may be driven or dragged, supported by the rotatable support members. As previously described, the precise position of the rotatable support members located with the first end portion and second end portion of each element 300 may be adjusted to adapt the dock for different size watercraft.

Additionally, the dock 100 includes three further elements 400 equivalent to element 300 apart from the removal of the intermediate portion. As such, each of these further elements 400 comprises a first end portion 410 and a second end portion 420 with a channel or gap between them. The elements 400 are positioned such that their first end portions 410 align with the first end portions 310 of elements 300, and such that the second end portions 420 align with the second end portions 320 of elements 300. As such, the channel or gap present in the elements 400 align with the intermediate portions 330 of the elements 300. The channel may therefore allow the passage of a keel as a watercraft is positioned on to the floating dock 1000.

Figure 5:
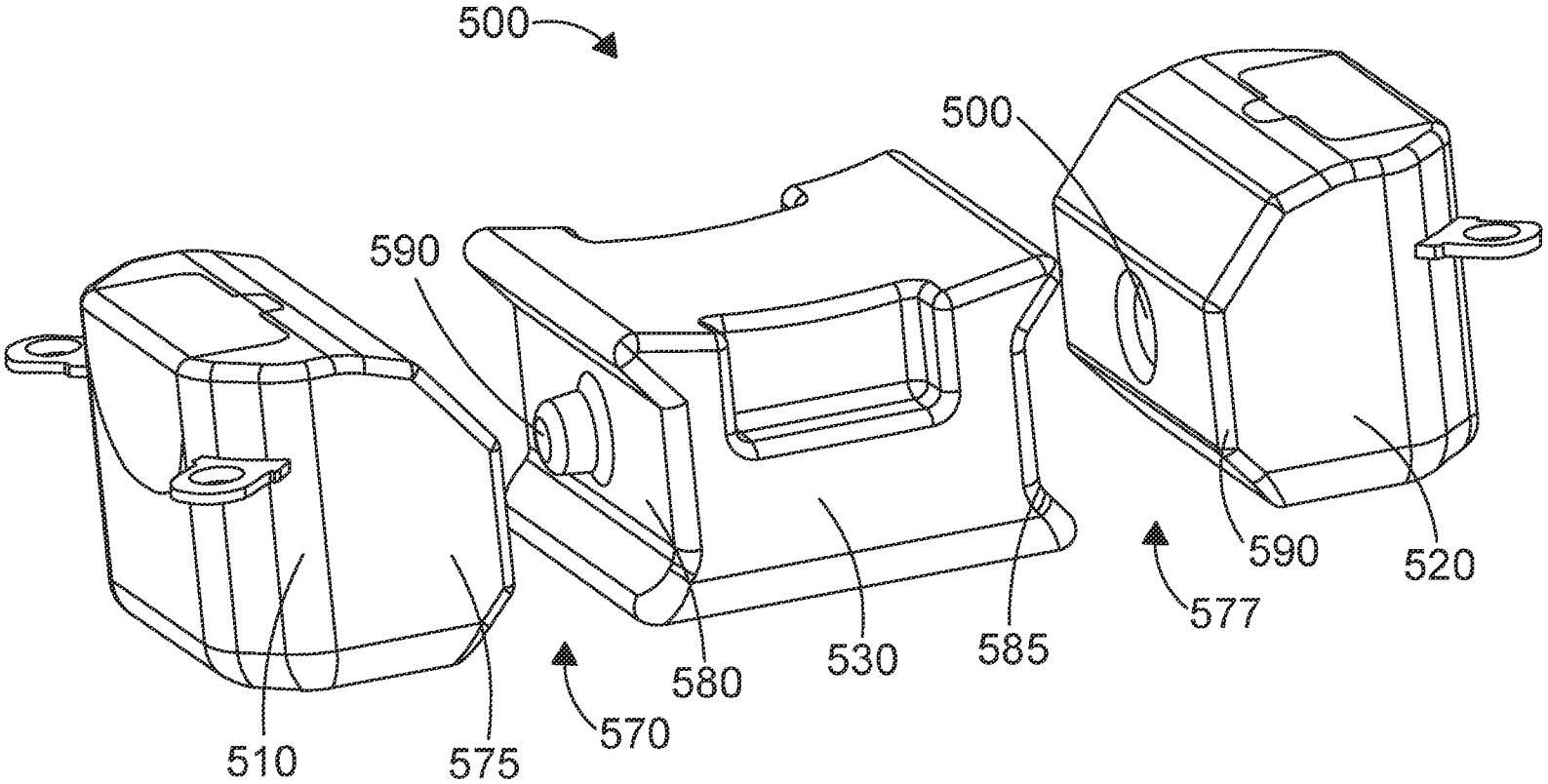
FIG. 5 is a schematic view of an element according to a fourth aspect of the present invention.

FIG. 5 depicts an element 500, again including a first end portion 510, a second end portion 520 and an intermediate portion as described in relation to FIG. 3. Whilst not all the feature of this embodiment of the invention are illustrated in FIG. 5, element 500 is substantially identical to element 300 with the exception of the connection between the first end portion 510 and the intermediate portion 530 and the connection between the second end portion 520 and the intermediate portion 530.

Turning firstly towards the connection between the first end portion 510 and the intermediate portion 530, the two are connected by an engagement formation 570. Here, the engagement formation comprises a first protrusion 575 extending from the first end portion 510 and a first recess 580 located within the intermediate portion 530. The first protrusion 575 is sized such that it fits within the first recess 580, and the first end portion 510 and the intermediate portion 530 are held together by a friction fit.

The first protrusion 575 generally tapers down as it extends away from the first end portion 510. As such, the cross sectional area of the first protrusion 575 reduces as the first protrusion 575 approaches the center of the element 500.

The first recess 580 comprises a central protrusion in the form of a knob 590. The knob 590 extends away from the intermediate portion 530, into the first recess 580 towards the first end portion 510. The knob 590 is sized to fit within a corresponding cavity within the first protrusion 575 where it is held by a friction or interference fit to secure the first end portion 510 and the intermediate portion 530 together, The second end portion 520 is connected to the intermediate portion 530 in an equivalent manner. The connection between the second end portion 520 and the intermediate portion 530 is a mirror image of the connection between the first end portion 510 and the intermediate portion 530 with a second engagement formation 577 comprising a second recess 585 and a second protrusion 590. Again, the second recess 585 comprises a central protrusion in the form of a knob. The knob extends away from the intermediate portion 530, into the second recess 585 towards the second end portion 520. The knob is sized to fit within a corresponding cavity within the second protrusion 595 where it is held by a friction or interference fit to secure the second end portion 520 and the intermediate portion 530 together, Locating the knobs of the first 570 and second 577 engagement formations on the intermediate portion may be advantageous as it increases the width of the central channel between the first end portion 510 and the second end portion 520 when the intermediate portion 530 is removed as illustrated in FIG. 4. Additionally, the incorporation of rotatable elements within the cavities may be useful in easing the passage of a watercraft on to a floating dock.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. An element for use in a floating dock, said element comprising:

a first rotatable support member and a second rotatable support member;

a first end portion, wherein said first rotatable support member is mounted on said first end portion;

a second end portion, wherein said second rotatable support member is mounted on said second end portion; and an intermediate portion extending between said first end portion and said second end portion, wherein said intermediate portion is connected to said first end portion and said second end portion such that, in use, when a load is placed on said element the connections between said end portions and said intermediate element become more secure;

wherein said first rotatable support member is mounted on said element such that the position of said first rotatable support member relative to said element can be varied by a user.

2. The element of claim 1, wherein the height of said first rotatable support member relative to said element can be varied by a user.

3. The element of claim 1 or claim 2, wherein the angle between said first rotatable support member and said element can be varied by a user.

4. The element of claim 1, wherein said second rotatable support member is mounted on said element such that the position of said second rotatable support member relative to said element can be varied by a user.

5. The element of claim 4, wherein the height of said second rotatable support member relative to said element can be varied by a user.

6. The element of claim 4, wherein the angle between said second rotatable support member and said element can be varied by a user.

7. The element of claim 1, wherein said intermediate portion comprises an intermediate rotatable support member.

8. The element of claim 7, wherein said intermediate rotatable support member comprises a roller.

9. The element of claim 7, wherein said intermediate portion comprises a plurality of intermediate rotatable support members.

10. The element of claim 1, wherein said intermediate portion is connected to said first end portion by a first engagement formation.

11. The element of claim 10, wherein said first engagement formation comprises a first protrusion extending from said first end portion into a first recess in said intermediate portion, where said first recess is sized to fit said first protrusion.

12. The element of claim 10, wherein said first engagement formation comprises a primary tapered portion and a secondary nodule.

13. The element of claim 10, wherein said first engagement formation comprises at least one line of symmetry.

14. The element of claim 1, wherein said intermediate portion is connected to said second end portion by a second engagement formation.

15. The element of claim 14, wherein said second engagement formation comprises a second protrusion extending from said second end portion into a second recess in said intermediate portion, where said second recess is sized to fit said second protrusion.

16. The element of claim 14, wherein said second protrusion comprises a primary tapered portion and a secondary nodule.

17. The element of claim 14, wherein said second engagement formation comprises at least one line of symmetry.

18. An element for use in a floating dock, said element comprising:

a first rotatable support member and a second rotatable support member;

a first end portion, wherein said first rotatable support member is mounted on said first end portion;

a second end portion, wherein said second rotatable support member is mounted on said second end portion; and an intermediate portion extending between said first end portion and said second end portion;

wherein said first rotatable support member is mounted on said element such that the position of said first rotatable support member relative to said element can be varied by a user; and wherein said intermediate portion is reversibly connectable to at least one of said first end portion and said second end portion.

19. The element of claim 1, wherein said first rotatable support member comprises a wheel.

20. The element of claim 1, wherein said element is buoyant in fresh water at a temperature of 20° C.

21. The element of claim 1, wherein said intermediate portion is a different color to said first end portion and said second end portion.

* * * * *